US009389620B2

(12) United States Patent
Banag

(10) Patent No.: US 9,389,620 B2
(45) Date of Patent: Jul. 12, 2016

(54) APPARATUS AND METHOD FOR A VOLTAGE REGULATOR WITH IMPROVED OUTPUT VOLTAGE REGULATED LOOP BIASING

(71) Applicant: Dialog Semiconductor GmbH, Kirchheim/Teck-Nabern (DE)

(72) Inventor: Franck Banag, Edinburgh (GB)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 186 days.

(21) Appl. No.: 14/052,832

(22) Filed: Oct. 14, 2013

(65) Prior Publication Data

US 2015/0097541 A1 Apr. 9, 2015

(30) Foreign Application Priority Data

Oct. 7, 2013 (EP) ..... 13368038

(51) Int. Cl.
*G05F 1/575* (2006.01)
*G05F 1/46* (2006.01)

(52) U.S. Cl.
CPC . *G05F 1/46* (2013.01); *G05F 1/575* (2013.01)

(58) Field of Classification Search
CPC . H02M 3/00; H02M 3/04; H02M 2001/0003; G05F 1/46; G05F 1/461; G05F 1/56; G05F 1/565; G05F 1/575
See application file for complete search history.

(56) References Cited

U.S. PATENT DOCUMENTS 5,266,887 A * 11/1993 Smith ..... G06F 1/561 323/316
6,046,577 A 4/2000 Rincon-Mora et al.
6,518,737 B1 2/2003 Stanescu et al.
6,696,822 B2 * 2/2004 Takabayashi ..... G05F 1/618 323/224
6,703,813 B1 3/2004 Vladislav et al.
7,166,991 B2 1/2007 Eberlein
8,289,009 B1 * 10/2012 Strik et al. ..... 323/272
2008/0218137 A1 9/2008 Okuyama et al.
2008/0218139 A1 * 9/2008 Takagi ..... 323/280
2009/0066306 A1 * 3/2009 Noda ..... 323/282
2009/0212753 A1 * 8/2009 Lou ..... G05F 1/563 323/277

FOREIGN PATENT DOCUMENTS

JP 2007 280025 10/2007

OTHER PUBLICATIONS

"Full On-Chip CMOS Low-Dropout Voltage Regulator," by Robert J. Milliken et al., IEEE Transactions on Circuits and Systems, I: Regular Papers, vol. 54, No. 9, Sep. 2007, pp. 1879-1890.

(Continued)

*Primary Examiner* — Gary L Laxton

(74) *Attorney, Agent, or Firm* — Saile Ackerman LLC; Stephen B. Ackerman

(57) ABSTRACT

An apparatus and method for a linear voltage regulator with improved voltage regulation is disclosed. A linear voltage regulator device with improved voltage regulation that combines good resiliency to noisy ground reference, high Power Supply Rejection Ratio (PSRR), good current load regulation with changes in the current load and good feedback loop stability. The linear voltage regulator comprises of an amplifier, a current source, a pass gate, a current load, a first feedback loop, a second feedback loop, a second amplifier and second pass gate. A second feedback loop is formed to control the bias of the first feedback loop.

27 Claims, 6 Drawing Sheets

(56) References Cited

OTHER PUBLICATIONS

"Performance Evaluation of Different Types of CMOS Operational Transconductance Amplifier," by Kalpesh B. Pandya et al., International Journal of Science and Research (IJSR) , vol. 2, No. 3, Published Mar. 15, 2013, 6 pgs.

European Search Report 13368038.9-1807 Mailed: Feb. 27, 2014, Dialog Semiconductor GmbH.

* cited by examiner

APPARATUS AND METHOD FOR A VOLTAGE REGULATOR WITH IMPROVED OUTPUT VOLTAGE REGULATED LOOP BIASING

BACKGROUND

1. Field

The disclosure relates generally to a linear voltage regulator circuits and, more particularly, to a linear voltage regulator circuit device having improved voltage regulation thereof.

2. Description of the Related Art

Linear voltage regulators are a type of voltage regulators used in conjunction with semiconductor devices, integrated circuit (IC), battery chargers, and other applications. Linear voltage regulators can be used in digital, analog, and power applications to deliver a regulated supply voltage.

An example of a prior art, a linear voltage regulators are illustrated in FIG. 1A. A first linear voltage regulator 10 is shown utilizing an n-type transistor pass element 40. A linear voltage regulator 10 consists of an amplifier 20, a current source 30, a pass gate 40, and a load 50 depicted by a resistor element 55 and capacitor element 60, though the load on a voltage regulator typically also includes active and inductive components. A feedback loop exists between the output of the pass gate 40 and amplifier 20. For a MOSFET-based implementation, the n-type pass transistor 40 can be typically an n-channel MOSFET device. The pass transistor 40 has a MOSFET drain connected to power supply voltage $V_{DD}$, and whose MOSFET source connected to output voltage, $V_{OUT}$, and whose MOSFET gate is connected to the output of amplifier 20. The amplifier 20 has a positive input defined as voltage reference input, $V_{REF}$, and a negative input signal feedback voltage from the feedback loop. As illustrated in FIG. 1B, a second linear voltage regulator 110 is shown utilizing a p-type transistor pass element 140. A linear voltage regulator 110 consists of an amplifier 120, a current source 130, a pass gate 140, a load 150 depicted as a resistor element 155 and capacitor element 160, though the load on a voltage regulator typically also includes active and inductive components. A feedback loop exists between the output of the pass gate 140 and amplifier 120. For a MOSFET-based implementation, the p-type pass transistor 140 can be a typically a p-channel MOSFET device. The pass transistor 140 has a MOSFET source connected to voltage $V_{DD}$, and whose MOSFET drain is connected to output voltage, $V_{OUT}$, and whose MOSFET gate is connected to the output of amplifier 120. The amplifier 120 has a negative input defined as voltage reference input, $V_{REF}$, and a positive input signal feedback voltage from the feedback loop.

Due to high switching currents from Class D audio amplifiers as well as the printed circuit board (PCB) impedance, the ground connection is very noisy with high voltage spikes. These voltage spikes are creating non-linear slew-rate limited perturbations on the output of the feedback amplifier. These voltage perturbations on the output of the feedback amplifier are transmitted as regulated voltage. A solution to make the design more robust to noise is to utilize a one stage operational transconductance amplifier (OTA)—as opposed to a multi-stage amplifier—as illustrated in FIG. 2. An operational transconductance amplifier 210 can consist of an amplifier with p-channel transistor loads 220A and 220B, and differential pair n-type transistor inputs 221A and 221B, a current source 230, a pass gate 240, feedback resistor divider network 250 and 251, a resistor element 252 and capacitor element 260.

A disadvantage of the single stage OTA is its low gain, limited by CMOS technology. CMOS technology has a low transconductance. A low transconductance leads to an undesirable low power supply rejection ratio (PSRR). Additionally, this also leads to a large static load dependent voltage offset, ΔVin. The voltage offset ΔVin can be defined as the current load differential (e.g. output current load $I_{LOAD}$ minus the typical current load $I_{LOAD}(O)$) divided by the gain parameter, G.

$$\Delta Vin=(I_{LOAD}-I_{LOAD}(O))/G$$

As the current load, $I_{LOAD}$, departs from the typical current load, $I_{LOAD}(O)$, a difference between the feedback voltage, $V_{FB}$, and the reference voltage, $V_{REF}$, is required to adjust the output current load to $I_{LOAD}$ Smaller is the gain, G larger will be the static load dependent voltage offset, ΔVin at the equilibrium point.

In linear voltage regulators, usage of operational transconductance amplifier (OTA) for has been discussed. As discussed in published U.S. Pat. No. 7,166,991 to Eberlein describes adaptive biasing concepts for current mode voltage regulations. Eberlein describes circuits and methods to achieve dynamic biasing for the complete loop transfer function of a current mode voltage regulator. The patent contains a pass transistor device, an operational transconductance amplifier (OTA), a feedback loop, and a feed-forward loop.

In low dropout regulators, tracking voltage divider networks have been discussed. As discussed in U.S. Pat. No. 6,703,813 to Vladislav et al., discloses a pass device, an error amplifier, a cascode device, and a tracking voltage divider. The tracking voltage divider adjusts the biasing to the cascode device.

In low dropout regulators, frequency compensation networks have been integrated into the feedback loop. As discussed in U.S. Pat. No. 6,518,737 to Stanescu et al, describes a pass transistor device, cascaded operational transconductance amplifiers (OTA), a feedback loop, a resistor divider feedback network, a frequency compensating capacitor integrated into the feedback loop.

In low dropout voltage regulators, transient boost circuits have been shown to address transient issues. Ads discussed in U.S. Pat. No. 6,046,577 to Rincon-Mora et al., describes a pass transistor device, a localized feedback loop, a resistor divider feedback network, a current mirror, and a transient boost circuit.

In these prior art embodiments, the solution to improve the response of the low dropout (LDO) regulator utilized various alternative solutions.

It is desirable to provide a solution to address the disadvantages of the operational transconductance amplifier (OTA) of large d.c. offset, low gain, and low PSRR.

SUMMARY

A principal object of the present disclosure is to provide a circuit device with good resilience to noisy reference ground.

A principal object of the present disclosure is to provide a circuit device with high power supply rejection ratio (PSRR).

Another further object of the present disclosure is to provide a circuit device with good current load regulation (e.g. low variation of the output voltage from a changing current load).

Another further object of the present disclosure is to provide a circuit device with good stability of the feedback loop without large internal or external capacitance.

The above and other objects are achieved by a low dropout device. The device comprising a power source, a first error amplifier, a pass transistor coupled to a first error amplifier and supplied from a power source, a feedback network electrically connected to a pass transistor and whose output is electrically coupled to the input of said first error amplifier, a current load, and a second error amplifier, and a current source controlled by the second amplifier connected in negative feedback summing/replacing the bias current of the first error amplifier.

As such, a novel low dropout (LDO) device with an improved voltage regulation combining good resiliency to noise, high PSRR, good current load regulation, and good feedback loop stability without a large internal/external capacitive load is desired. Other advantages will be recognized by those of ordinary skill in the art.

BRIEF DESCRIPTION OF THE DRAWINGS

The present disclosure and the corresponding advantages and features provided thereby will be best understood and appreciated upon review of the following detailed description of the disclosure, taken in conjunction with the following drawings, where like numerals represent like elements, in which.

DETAILED DESCRIPTION

Figure 1A:
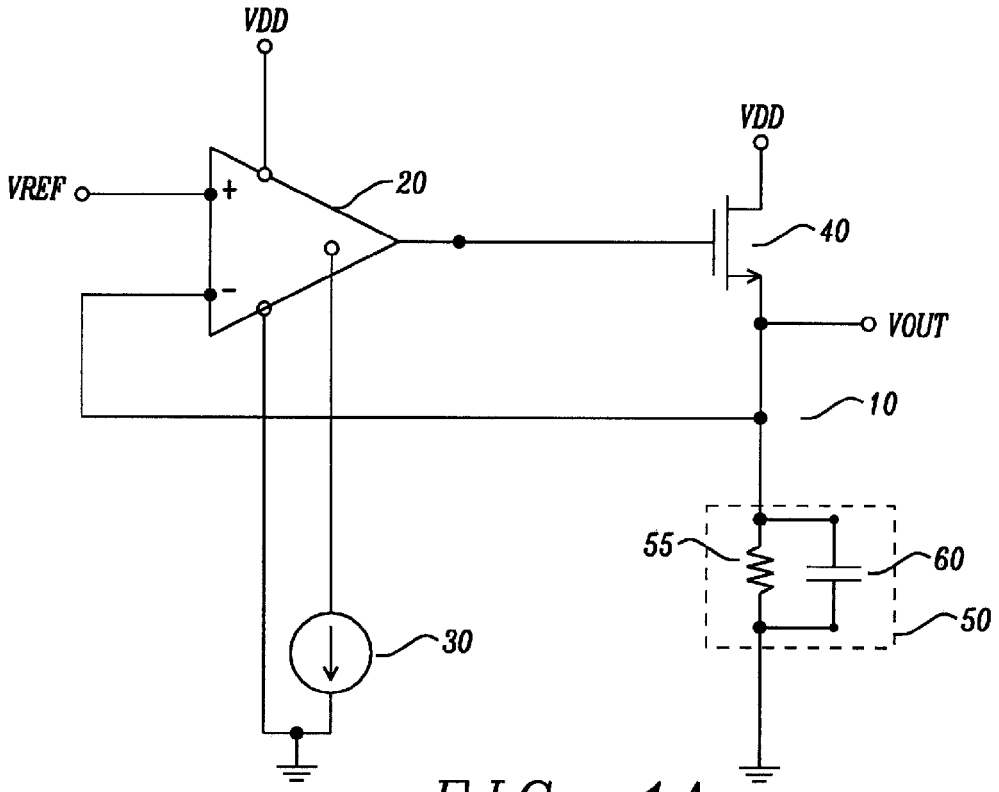
FIG. 1A is a circuit schematic diagram illustrating a prior art embodiment of a typical linear voltage regulator with a n-type pass transistor.

FIG. 1A is a circuit schematic diagram illustrating a prior art embodiment of a linear voltage regulator in accordance with a prior art embodiment. A first linear voltage regulator 10 is shown utilizing an n-type transistor pass element 40. A linear voltage regulator 10 consists of an amplifier 20, a current source 30, a pass gate 40, and a load 50 depicted by a resistor element 55 and capacitor element 60, though the load on a voltage regulator typically also includes active and inductive components. A feedback loop exists between the output of the pass gate 40 and amplifier 20. For a MOSFET-based implementation, the n-type pass transistor 40 can be a typically an n-channel MOSFET device. The pass transistor 40 has a MOSFET drain connected to power supply voltage $V_{DD}$, and whose MOSFET source connected to output voltage, $V_{OUT}$, and whose MOSFET gate is connected to the output of amplifier 20. The amplifier 20 has a positive input defined as voltage reference input, $V_{REF}$, and a negative input signal feedback voltage from the feedback loop.

Figure 1B:
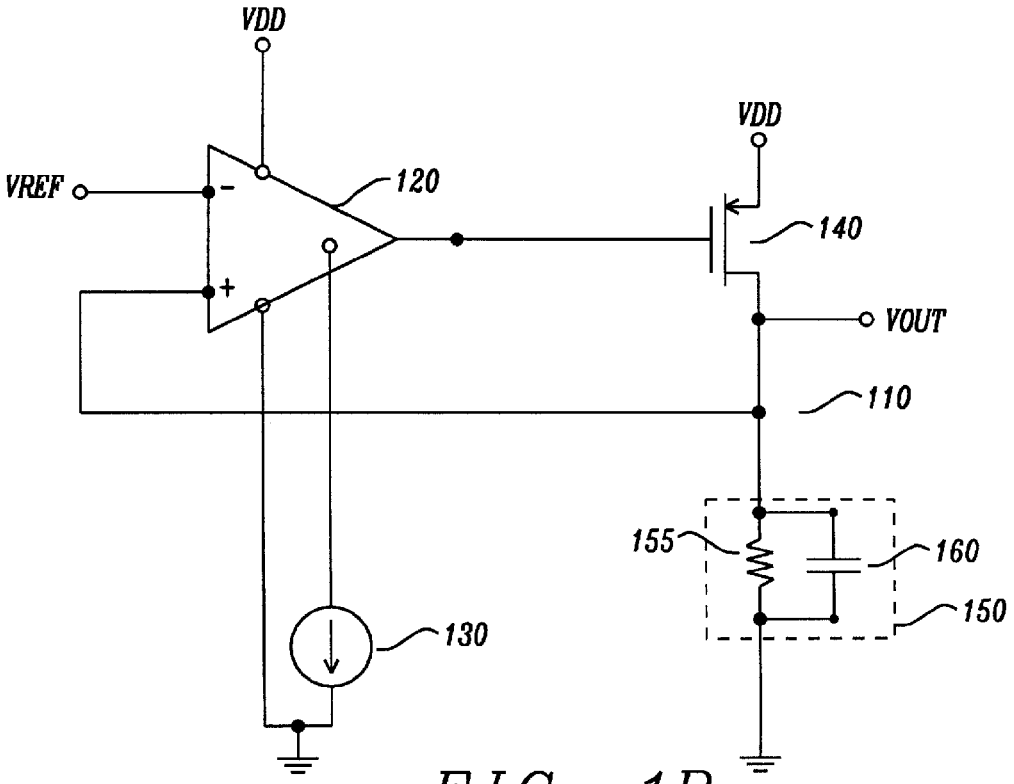
FIG. 1B is a circuit schematic diagram illustrating a prior art embodiment of a typical linear voltage regulator with a p-type pass transistor.

FIG. 1B is a circuit schematic diagram illustrating a prior art embodiment of a linear voltage regulator in accordance with a prior art embodiment. A second linear voltage regulator 110 is shown utilizing a p-type transistor pass element 140. A linear voltage regulator 110 consists of an amplifier 120, a current source 130, a pass gate 140, a load 150 depicted as a resistor element 155 and capacitor element 160, though the load on a voltage regulator typically also includes active and inductive components. A feedback loop exists between the output of the pass gate 140 and amplifier 120. For a MOSFET-based implementation, the p-type pass transistor 140 can be a typically a p-channel MOSFET device. The pass transistor 140 has a MOSFET source connected to voltage $V_{DD}$, and whose MOSFET drain is connected to output voltage, $V_{OUT}$, and whose MOSFET gate is connected to the output of amplifier 120. The amplifier 120 has a negative input defined as voltage reference input, $V_{REF}$, and a positive input signal feedback voltage from the feedback loop.

Figure 2:
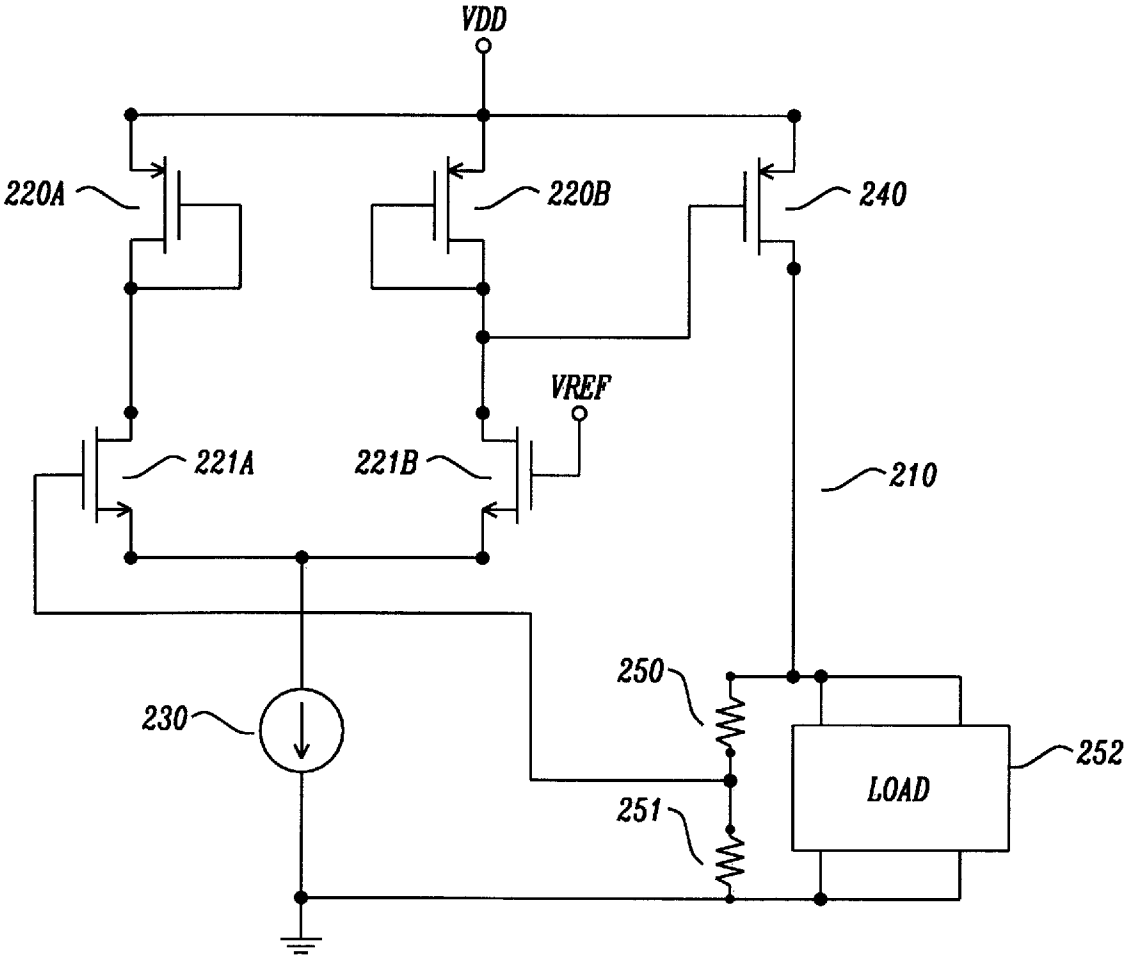
FIG. 2 is a circuit schematic illustrating a prior art embodiment of a linear voltage regulator with operational transconductance amplifier (OTA) type feedback loop.

FIG. 2 is a circuit schematic illustrating a prior art embodiment of a linear voltage regulator with operational transconductance amplifier (OTA) type feedback loop. An operational transconductance amplifier 210 can be consists of an amplifier with p-channel transistor loads 220A and 220B, and differential pair n-type transistor inputs 221A and 221B, a current source 230, a pass gate 240, feedback resistor divider network 250 and 251, and a load 252, whereas the load can consist of resistance, capacitance, and inductance. Due to high switching currents from Class D audio amplifiers as well as the printed circuit board (PCB) impedance, the ground connection is very noisy with high voltage spikes. These voltage spikes are creating non-linear slew-rate limited perturbations on the output of the feedback amplifier. These voltage perturbations on the output of the feedback amplifier are transmitted as regulated voltage. A solution to make the design more robust to noise is to utilize a one stage operational transconductance amplifier (OTA), as illustrated in FIG. 2.

Figure 3:
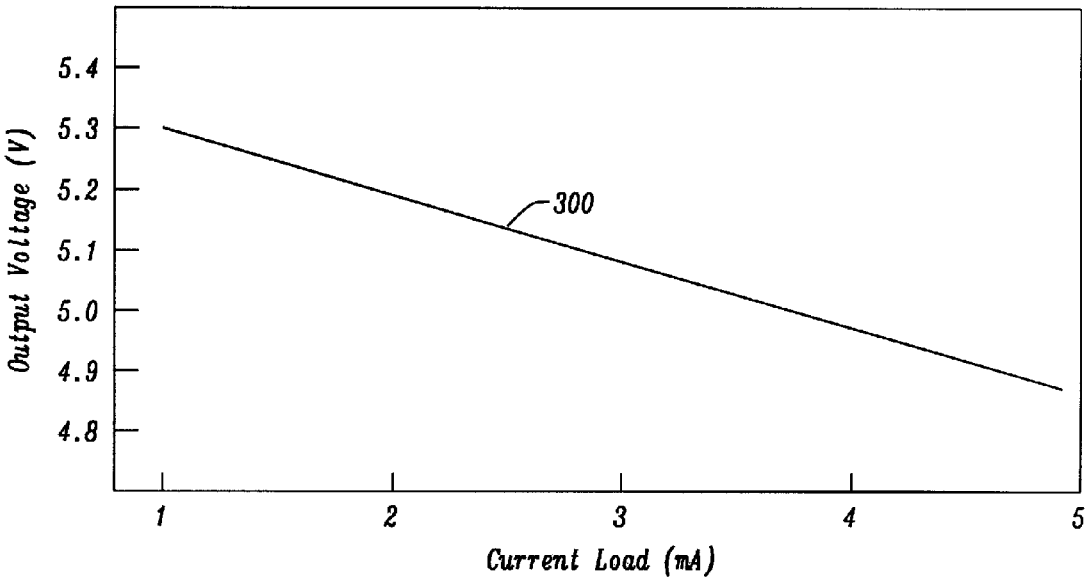
FIG. 3 is a plot highlighting the linear voltage regulator output variation from current load changes.

FIG. 3 is a plot highlighting the linear voltage regulator output variation from current load changes. As illustrated in FIG. 3, the linear voltage regulator voltage variation is shown as a function of the d.c. current load for a circuit shown in FIG. 2. A fixed voltage is not achieved due to the lack of gain in the prior art implementation. As illustrated in FIG. 3, according to the data represented by the curve 300, it is clear that there is poor control of a fixed voltage as a function of the current load. As can be observed from the plot, the output voltage varies from 5.3 to below 4.9 V as the current load varies.

Figure 4:
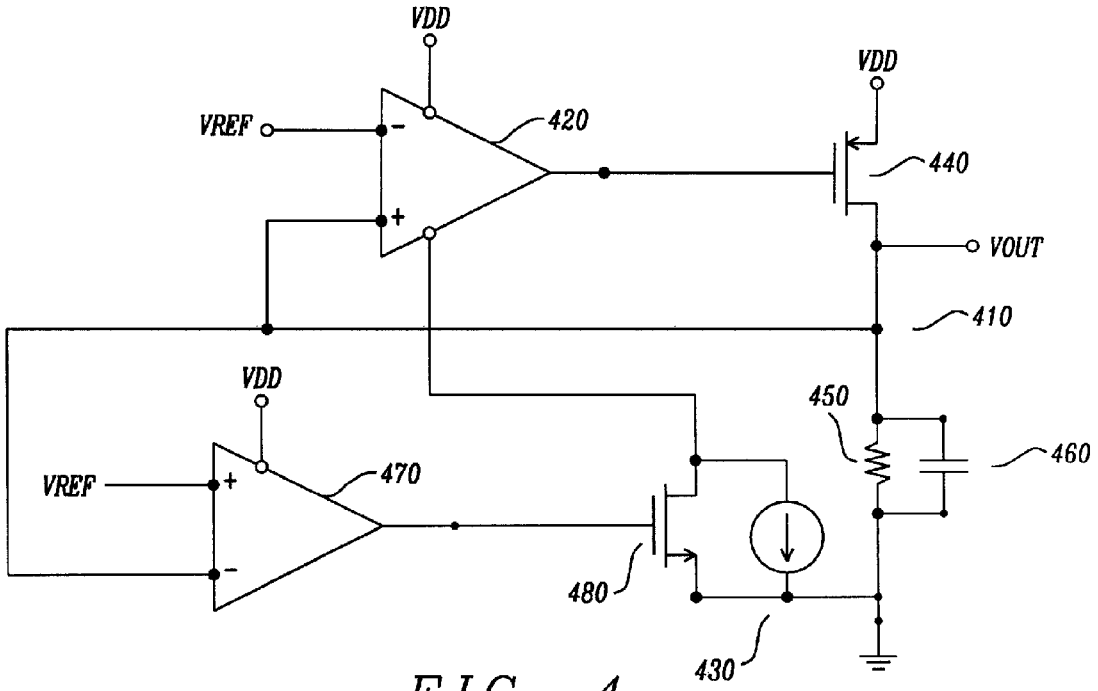
FIG. 4 is a circuit schematic diagram illustrating a linear voltage regulator with a second feedback loop in accordance with one embodiment of the disclosure.

FIG. 4 is a circuit schematic diagram illustrating a linear voltage regulator with a second feedback loop in accordance with one embodiment of the disclosure. A linear voltage regulator 410 is shown utilizing a p-type transistor pass element 440. A linear voltage regulator 410 comprises of an amplifier 420, a current source 430, a pass gate 440, and a load, depicted by a resistor element 450 and capacitor element 460, though a voltage regulator typically also includes some amount of inductance (not shown). A first feedback loop exists between the output of the pass gate 440 and amplifier 420. For a MOSFET-based implementation, the p-type pass transistor 440 can be a typically a p-channel MOSFET device. The pass transistor 440 has a MOSFET source connected to power supply voltage $V_{DD}$, and whose MOSFET drain is connected to output voltage, $V_{OUT}$, and whose MOSFET gate is connected to the output of amplifier 420. The amplifier 420 has a negative input defined as voltage reference input, $V_{REF}$, and a positive input signal feedback voltage from the first feedback loop. A second feedback loop is formed to control not the pass gate 440, but instead the bias of the first feedback loop. A second amplifier 470 is connected to an n-type pass transistor 480. The negative input of the second amplifier 470 is connected the positive input of said first amplifier 420. The positive input of the second amplifier is connected to the voltage reference input, $V_{REF}$. The output of the second amplifier 470 is connected to the gate of n-type pass transistor 480. The n-type pass transistor 480 is in a parallel configuration with the current source 430.

In this implementation, as illustrated in FIG. 4, the linear voltage regulator device with improved voltage regulation, the device comprises of a first error amplifier 420, a second amplifier 470, a first pass transistor 440 where a first pass transistor coupled to the first error amplifier 420. In addition, a second pass transistor 480 is coupled to the second error amplifier 470. The feedback network is electrically connected to said first pass transistor 470 and whose output is electrically coupled to the input of the first error amplifier 420, and electrically coupled to the input of the second error amplifier 470. In addition, there is a current load (e.g. resistor 450, and capacitor 460). In addition there is a current source 430 controlled by the second error amplifier 470 which is electrically connected in negative feedback summing or replacing the bias current of the first error amplifier 420.

In this implementation, as illustrated in FIG. 4, the linear voltage regulator device has a first pass transistor 440 which is a p-channel MOSFET device, and the second pass transistor 480 is an n-channel MOSFET device. Note that the first pass transistor is of a first dopant polarity, and said second pass transistor is of a second dopant polarity.

In this implementation, as illustrated in FIG. 4, the linear voltage regulator device has a feedback loop which is connected to the positive input terminal of the first error amplifier 440 and the same feedback loop is connected to the negative input terminal of the second error amplifier 470. The feedback loop can be considered a single feedback loop with two parallel branches with a first branch that continues to the first error amplifier 440 and a second branch that continues to the second error amplifier 470. The feedback loop can also be considered as two feedback loops with a first feedback loop that continues to the first error amplifier 440 and a second feedback loop that continues to the second error amplifier 470.

Figure 5:
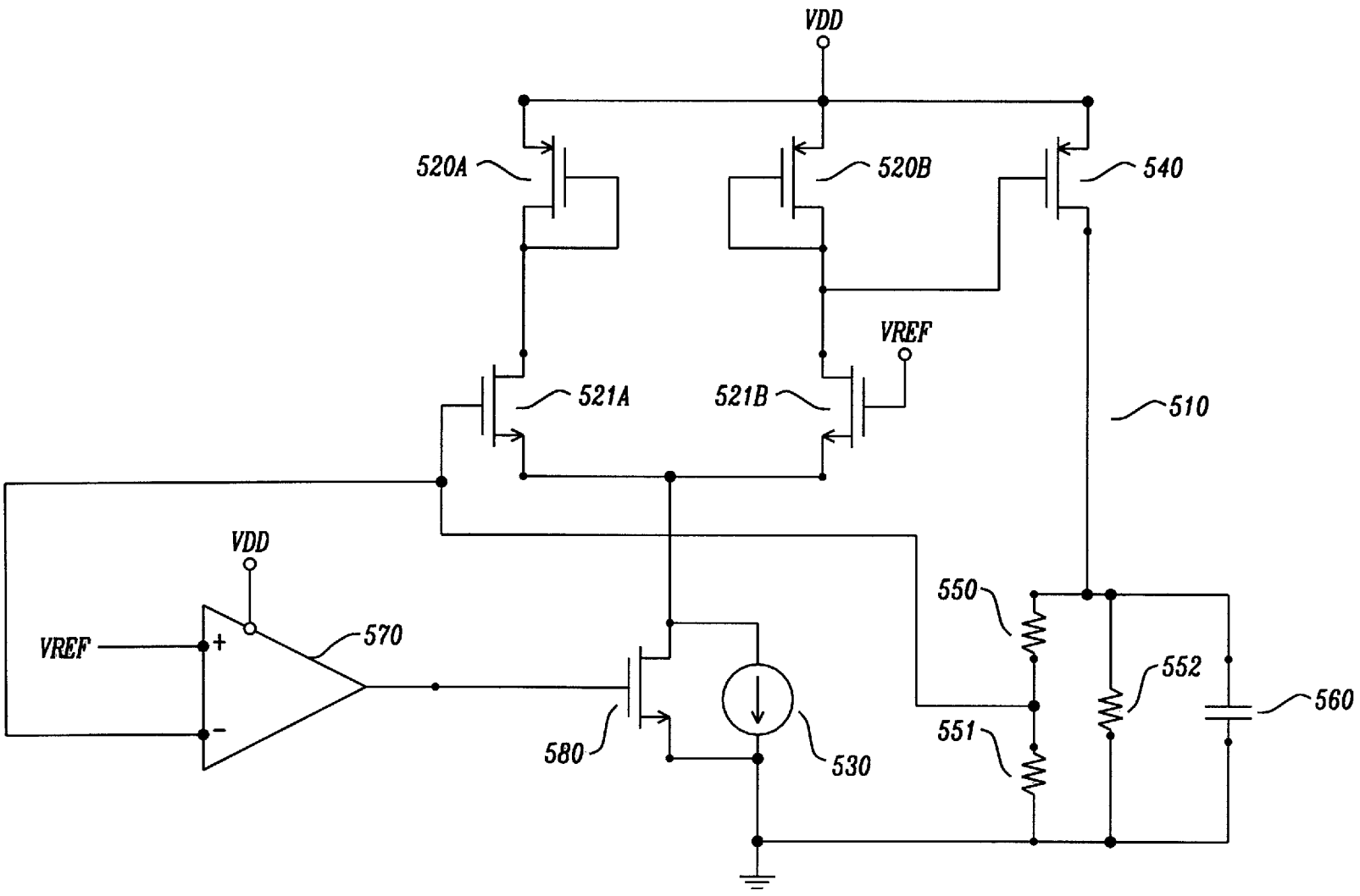
FIG. 5 is a circuit schematic diagram illustrating a linear voltage regulator in accordance with a second embodiment of the disclosure.

FIG. 5 is a circuit schematic diagram illustrating a linear voltage regulator in accordance with a second embodiment of the disclosure. FIG. 5 is a circuit schematic illustrating an embodiment of a linear voltage regulator with operational transconductance amplifier (OTA) type feedback loop and a second feedback loop. An operational transconductance amplifier 510 can be comprises of an amplifier with p-channel transistor loads 520A and 520B, and differential pair n-type transistor inputs 521A and 521B, a current source 530, a pass gate 540, feedback resistor divider network 550 and 551, a resistor element 552 and capacitor element 560. A second feedback loop is formed to control not the pass gate 540, but the instead the bias of the first feedback loop. A second amplifier 570 is connected to an n-type pass transistor 580. The negative input of the second amplifier 570 is connected the positive input of said first feedback loop. The positive input of the second amplifier is connected to the voltage reference input, $V_{REF}$. The output of the second amplifier 570 is connected to the gate of n-type pass transistor 580. The n-type pass transistor 580 is in a parallel configuration with the current source 530.

Figure 6:
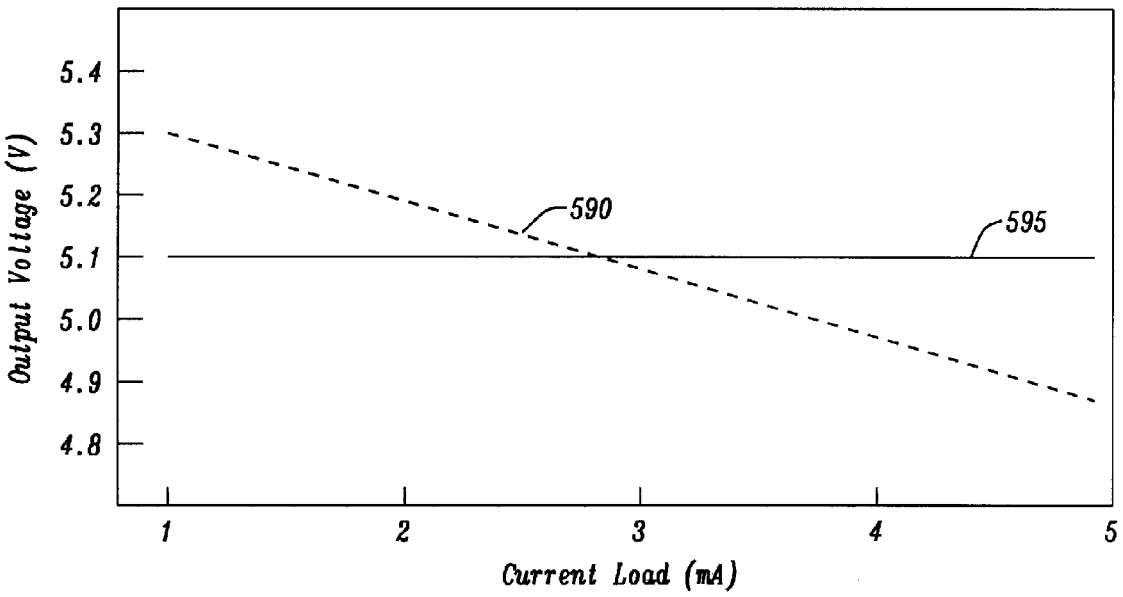
FIG. 6 is a plot highlighting the linear voltage regulator output variation from current load changes in accordance with one embodiment of the disclosure.

FIG. 6 is a plot highlighting the linear voltage regulator output variation from current load changes for the prior art embodiment and the improved embodiment in the disclosure. As illustrated in FIG. 6, the linear voltage regulator voltage variation is shown as a function of the d.c. current load for a circuit shown in FIG. 5. As shown in FIG. 6, the dashed line data 590 for the prior art embodiment varies from 5.3V to below 4.9V as the current load is varied. A fixed voltage is not achieved due to the lack of gain in the prior art implementation. FIG. 6 shows the embodiment of FIG. 5 as illustrated by solid line data 595. As illustrated in FIG. 6, according to the data represented by the curve 595, very small deviation occurs in the output voltage as the current load is varied, demonstrating the advantage of the circuit with the improved voltage regulation.

Figure 7:
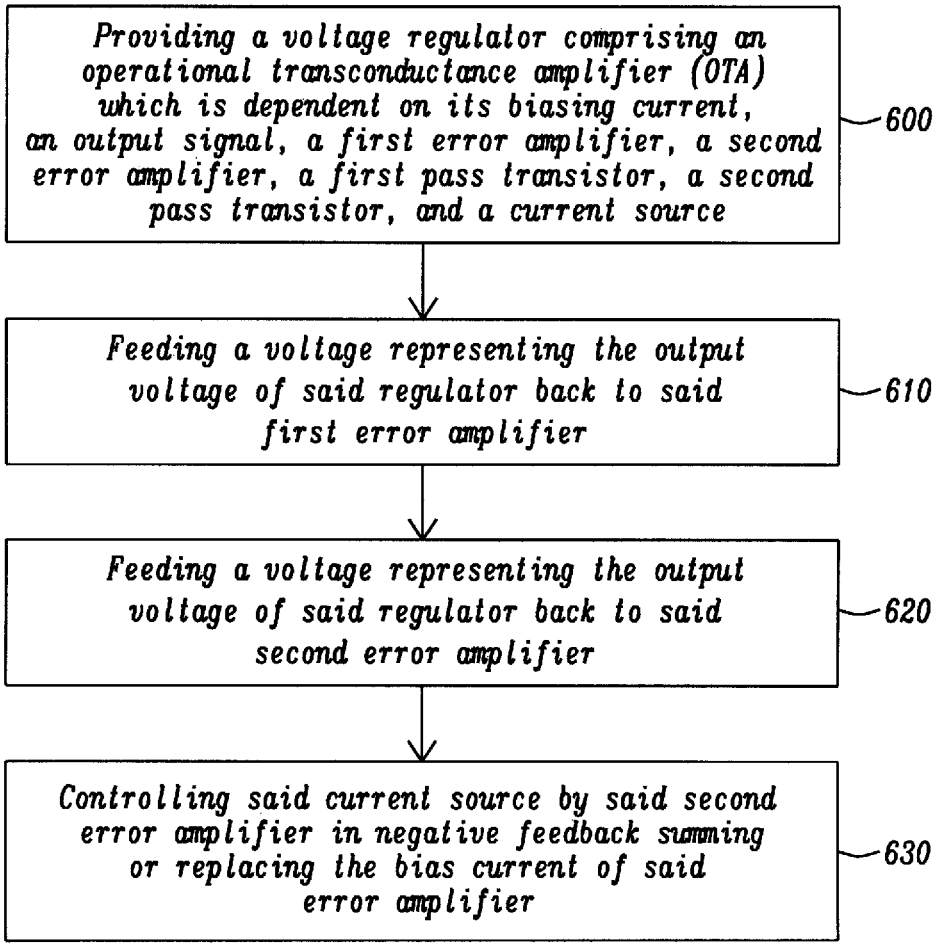
FIG. 7 is a method for providing improved voltage regulation in a linear voltage regulator circuit.

FIG. 7 is a method of an improved voltage regulation in linear voltage regulator. The method of regulating loop biasing in a voltage regulator comprises the steps of providing a voltage regulator comprising an operational transconductance amplifier (OTA) which is dependent on its biasing current, an output signal, a first error amplifier, a second error amplifier, a first pass transistor, and a second pass transistor, and a current source 600; feeding a voltage representing the output voltage of said regulator back to said first error amplifier 610; feeding a voltage representing the output voltage of said regulator back to said second error amplifier 620; and, controlling said current source by said second error amplifier in negative feedback summing or replacing the bias current of said first error amplifier 630.

The linear voltage regulator can be defined using bipolar transistors, or metal oxide semiconductor field effect transistors (MOSFETs). The linear voltage regulator can be formed in a complementary metal oxide semiconductor (CMOS) technology and utilize p-channel and n-channel field effect transistors (e.g. PFETs and NFETs, respectively). The linear voltage regulator can be formed in a bipolar technology utilizing homo-junction bipolar junction transistors (BJT), or hetero-junction bipolar transistors (HBT) devices. The linear voltage regulator can be formed in a power technology utilizing lateral diffused metal oxide semiconductor (LDMOS) devices. The LDMOS devices can be an n-type LDMOS (NDMOS), or p-type LDMOS (PDMOS). The linear voltage regulator can be formed in a bipolar-CMOS (BiCMOS) technology, or a bipolar-CMOS-DMOS (BCD) technology. The linear voltage regulator can be defined using both planar MOSFET devices, or non-planar FinFET devices.

As such, a novel linear voltage regulator with improved voltage regulation are herein described. The improvement is achieved with minimal impact on silicon area or power usage. The improved linear voltage regulator circuit improves voltage regulation combining good resiliency to noisy ground reference, high Power Supply Rejection Ratio (PSBR), good current load regulation with changes in the current load and good feedback loop stability. Other advantages will be recognized by those of ordinary skill in the art. The above detailed description of the disclosure, and the examples described therein, has been presented for the purposes of illustration and description. While the principles of the disclosure have been described above in connection with a specific device, it is to be clearly understood that this description is made only by way of example and not as a limitation on the scope of the disclosure.

What is claimed is:

1. A linear voltage regulator device with improved voltage regulation, the device comprising:

a first error amplifier;

a second error amplifier;

a first pass transistor coupled to said first error amplifier;

a second pass transistor coupled to said second error amplifier;

a feedback network configured to provide two parallel branches wherein said feedback network is electrically connected to said first pass transistor and whose output is electrically coupled to an input of said first error amplifier, and electrically coupled to an input of said second error amplifier; and a current source controlled by said second error amplifier wherein said current source is configured in parallel to said second pass transistor to provide negative feedback summing and/or replacing the bias current of said first error amplifier.

2. The linear voltage regulator device with improved voltage regulation of claim 1 wherein said first pass transistor is of a first dopant polarity, and said second pass transistor is of a second dopant polarity.

3. The linear voltage regulator device with improved voltage regulation of claim 1 wherein said feedback loop configured to provide two parallel branches wherein the first branch is connected to a positive input terminal of said first error amplifier, and the second branch continues and is connected to a negative input terminal of said second error amplifier.

4. The linear voltage regulator device with improved voltage regulation of claim 1 wherein said pass transistor has a MOSFET source connected to power supply voltage $V_{DD}$, and whose MOSFET drain is connected to output voltage, $V_{OUT}$, and whose MOSFET gate is connected to the output of said first amplifier.

5. The linear voltage regulator device with improved voltage regulation of claim 1 wherein the negative input of said second amplifier is connected the positive input of said first amplifier.

6. The linear voltage regulator device with improved voltage regulation of claim 1 wherein the positive input of the second amplifier is connected to the voltage reference input, $V_{REF}$.

7. The linear voltage regulator device with improved voltage regulation of claim 1 wherein the output of said second amplifier is connected to the gate of an n-type pass transistor.

8. The linear voltage regulator device with improved voltage regulation of claim 7 wherein the n-type pass transistor is in a parallel configuration with said current source.

9. The linear voltage regulator device with improved voltage regulation of claim 1 wherein provides resiliency to ground noise.

10. The linear voltage regulator device with improved voltage regulation of claim 1 wherein provides an improved Power Supply Rejection Ratio (PSRR).

11. The linear voltage regulator device with improved voltage regulation of claim 1 wherein provides current load regulation.

12. The linear voltage regulator device with improved voltage regulation of claim 1 wherein provides stability of said feedback loop.

13. A linear voltage regulator device with improved voltage regulation, the device comprising:

a first error amplifier;

a second error amplifier;

a first pass transistor coupled to said first error amplifier;

a second pass transistor coupled to said second error amplifier;

a first feedback network electrically connected to said first pass transistor and whose output is electrically coupled to the input of said first error amplifier;

a second feedback network electrically connected to said first feedback network and coupled to the input of said second error amplifier; and a current source controlled by said second error amplifier wherein said current source is configured in parallel to said second pass transistor.

14. The linear voltage regulator device with improved voltage regulation of claim 13 wherein said first pass transistor is of a first dopant polarity, and said second pass transistor is of a second dopant polarity.

15. The linear voltage regulator device with improved voltage regulation of claim 13 wherein said first feedback loop is connected to the positive input terminal of said first error amplifier, and said second feedback loop is connected to the negative input terminal of said second error amplifier.

16. The linear voltage regulator device with improved voltage regulation of claim 13 wherein said pass transistor has a MOSFET source connected to power supply voltage $V_{DD}$, and whose MOSFET drain is connected to output voltage, $V_{OUT}$, and whose MOSFET gate is connected to the output of said first amplifier.

17. The linear voltage regulator device with improved voltage regulation of claim 13 wherein the negative input of said second amplifier is connected the positive input of said first amplifier.

18. The linear voltage regulator device with improved voltage regulation of claim 13 wherein the positive input of the second amplifier is connected to the voltage reference input, $V_{REF}$.

19. The linear voltage regulator device with improved voltage regulation of claim 13 wherein the output of said second amplifier is connected to the gate of an n-type pass transistor.

20. The linear voltage regulator device with improved voltage regulation of claim 19 wherein the n-type pass transistor is in a parallel configuration with said current source.

21. A linear voltage regulator device with improved operational transconductance amplifier (OTA) feedback voltage regulation, the device comprising:

a first error amplifier;

a second error amplifier;

a first pass transistor coupled to said first error amplifier and supplied from said power source;

a second pass transistor coupled to said second error amplifier;

a first feedback network electrically connected to said first pass transistor and whose output is electrically coupled to the input of said first error amplifier;

a second feedback network electrically connected to said first feedback network and electrically coupled to the input of said second error amplifier; and a current source controlled by said second error amplifier wherein said current source is configured in parallel to said second pass transistor.

22. The linear voltage regulator device with improved operational transconductance amplifier (OTA) feedback voltage regulation of claim 21, wherein said first error amplifier further comprising:

A first p-channel MOSFET whose source is connected to a power source;

A second p-channel MOSFET whose source is connected to a power source;

A first n-channel MOSFET whose drain is connected to said first p-channel MOSFET drain and gate, whose gate is connected to said first feedback loop and whose source is connected to said current source; and A second n-channel MOSFET whose drain is connected to said second p-channel MOSFET drain and gate and said first pass transistor gate, whose gate is connected to said a voltage reference, $V_{REF}$, and whose source is connected to said current source.

23. A method of regulating loop biasing in a voltage regulator is comprising the steps of:

providing a voltage regulator comprising an operational transconductance amplifier (OTA) which is dependent on its biasing current, an output signal, an output load, a first error amplifier, a second error amplifier, a first pass transistor, and a second pass transistor, a feedback network, and a current source;

feeding a voltage representing the output voltage of said regulator back to said first error amplifier;

feeding a voltage representing the output voltage of said regulator back to said second error amplifier; and controlling said current source by said second error amplifier in negative feedback summing or replacing the bias current of said first error amplifier.

24. The method of regulating loop biasing in a voltage regulator of claim 23 further comprising of a power source.

25. The method of regulating loop biasing in a voltage regulator of claim 23 further comprising of a output load.

26. The method of regulating loop biasing in a voltage regulator of claim 23 wherein a voltage representing the output voltage of said regulator is fed back to said first error amplifier of its positive input terminal.

27. The method of regulating loop biasing in a voltage regulator of claim 23 wherein a voltage representing the output voltage of said regulator is fed back to said second error amplifier of its negative input terminal.

* * * * *